US012595709B2

(12) United States Patent
Stenshorne et al.

(10) Patent No.: US 12,595,709 B2
(45) Date of Patent: Apr. 7, 2026

(54) ARRANGEMENT FOR CONTROLLING VOLUME IN A GAS OR OIL WELL SYSTEM

(71) Applicant: Enhanced Drilling AS, Straume (NO)

(72) Inventors: Per Christian Stenshorne, Oslo (NO); Gustav Olov Skärgård, Oslo (NO)

(73) Assignee: Enhanced Drilling AS, Straume (NO)

( * ) Notice: Subject to any disclaimer, the term of this patent is extended or adjusted under 35 U.S.C. 154(b) by 610 days.

(21) Appl. No.: 17/779,948

(22) PCT Filed: Dec. 17, 2020

(86) PCT No.: PCT/NO2020/050319

§ 371 (c)(1),
(2) Date: May 25, 2022

(87) PCT Pub. No.: WO2021/125974

PCT Pub. Date: Jun. 24, 2021

(65) Prior Publication Data

US 2022/0412175 A1 Dec. 29, 2022

(30) Foreign Application Priority Data

Dec. 18, 2019 (NO) ..... 20191492

(51) Int. Cl.
*E21B 21/08* (2006.01)
*E21B 44/00* (2006.01)
*E21B 47/10* (2012.01)

(52) U.S. Cl.
CPC ..... *E21B 21/08* (2013.01); *E21B 44/00* (2013.01); *E21B 47/10* (2013.01)

(58) Field of Classification Search
CPC ..... E21B 21/08; E21B 44/00
See application file for complete search history.

(56) References Cited

U.S. PATENT DOCUMENTS 3,976,148 A 8/1976 Maus et al.
4,291,772 A * 9/1981 Beynet ..... E21B 21/08 175/25

(Continued)

FOREIGN PATENT DOCUMENTS

AU 2011244852 A1 12/2011
AU 2014227488 A1 10/2014

(Continued)

OTHER PUBLICATIONS

Nguyen, Hai Vu; International Search Report; PCT/NO2020/050319; dated Mar. 3, 2021; 4 pages.

*Primary Examiner* — Yong-Suk (Philip) Ro
(74) *Attorney, Agent, or Firm* — Bradley Arant Boult Cummings LLP

(57) ABSTRACT

The invention relates to an arrangement and methods to control volume of fluids in a well system having a riser (7) extending from a well to a rig. The riser (7) has an increased diameter section (1) situated below the upper end of the riser (7) and above any slip joint (12) in the riser. The arrangement further comprises a sensor (5) to continuously measure the position of the slip joint (12). the increased diameter section (1) is coupled to an outlet (19) that is in fluid communication with a fluid return system (18), and the arrangement further comprises a return pump (2) coupled between the outlet (19) and the mud return system (18). The outlet (19) is arranged at a lower level than the mud return system (18). Level sensors (22) measure the level of liquid within the increased diameter section (1).

12 Claims, 12 Drawing Sheets

(56) References Cited

U.S. PATENT DOCUMENTS

| | | | | |
|---|---|---|---|---|
| 9,759,024 | B2 * | 9/2017 | Leuchtenberg | E21B 17/07 |
| 2004/0238177 | A1 | 12/2004 | Fossli | |
| 2007/0289746 | A1 | 12/2007 | Fossli | |
| 2012/0067590 | A1 | 3/2012 | Fossli | |
| 2016/0215587 | A1 * | 7/2016 | Vavik | E21B 21/08 |

FOREIGN PATENT DOCUMENTS

| | | | |
|---|---|---|---|
| CN | 102803645 | A | 11/2012 |
| EP | 3128120 | A1 | 2/2017 |
| NO | 20190900 | A1 | 3/2004 |
| WO | WO-2014055090 | A1 | 4/2014 |

* cited by examiner

ARRANGEMENT FOR CONTROLLING VOLUME IN A GAS OR OIL WELL SYSTEM

TECHNICAL FIELD

The present invention is directed to volume control of fluids in a gas or oil well, especially to detect kicks and loss of mud into the formation. Simulations has shown that the system of the present invention will be able to detect small kicks and losses.

The invention can be used in drilling oil or gas wells, both on land and offshore. It can also be used during intervention, work-over, cementing, injection or other types of operations in the well where it is desired to keep control of the volume of fluids in the well.

With the system of the present invention it is possible to detect both an influx of gas, liquid or a mixture of both and loss of fluids due for instance to leakage into the formation.

BACKGROUND ART

In conventional drilling systems, the riser is kept substantially full to the top at all times. Mud is pumped down the drill string and flow up the annulus between the drill string and the wellbore, casing or riser. At the top of the riser is an outlet referred to as the bell nipple, typically located within the diverter housing. When the mud reaches the bell nipple, it flows through an outlet pipe coupled to the bell nipple called the flowline, which returns the mud to the cuttings shakers and onwards to the mud pit.

On floating offshore drilling vessels, the riser has a telescopic joint (also called slip joint) that takes up movements between the vessel and the drilling riser, which is connected to the seabed. The movement of the slip joint results in a change in the length, and hence volume of the riser. Consequently, an increased amount of mud will flow to the top of the riser and out through the bell nipple when the slip joint is being compressed, and when the slip joint is being extended the flow out through the bell nipple will decrease or in some cases even stop. Since the change of riser volume per time unit caused by slip joint motion in harsh weather can be higher than normal flow rates caused by pumping through the drillstring during drilling, the level of mud in the riser may also drop below the bell-nipple outlet during this process.

This fluctuating flow of mud through the bell nipple and outlet pipe makes it difficult to measure the flow of mud out of the riser. As the flow varies substantially, the outlet pipe must have a diameter sufficiently large to accommodate the highest expected flow. This means that when the flow is less, the outlet pipe may not be full of mud across the entire cross section. The result of the above is that it is difficult to determine accurately the volume of mud in the riser and hence the total volume of mud in the well system. In addition, as the slip joint is continuously being extended and retracted with rig motion, the measured flow out of the well, as measured in the flowline will vary constantly, even when the flow rate up the riser below the slip joint is constant. In severe weather conditions, one could typically experience wave periods of 10 seconds, which could give instantaneous riser volume changes of 10,000-15,000 litres per minute. In addition, there may be movement of the slip-joint associated with station keeping, as the rig in practice will move along all three axes. Typical drilling rates, including boost rates for deep-water rigs would be 6000-8000 litres per minute. As the rig motion varies all the time, the flow-out changes from motion will in practice not be a perfect sinusoidal form, but rather exhibit an erratic behaviour.

Flowrate measurement devices such as Coriolis flow meters have inaccuracies. These inaccuracies in flow measurements can be difficult to distinguish from the erratic behaviour of the flow-out changes. Many efforts have been made in the industry to account for this effect with algorithms and improved measurement methods, but for all current methods there are residual measurement uncertainties from these effects.

WO2014/055090 shows a slip joint with an outlet. The outlet is coupled to a mud return system (represented by a choke manifold, a degasser and a reservoir). The outlet is arranged below the mud return system. The system is only capable of functioning under so-called Managed Pressure Drilling, i.e. when the seal above the slip joint is closed and the riser is under pressure. When the seal is open, or if there is no seal, the system will not be able to return mud from the slip joint to the mud return system.

U.S. Pat. No. 3,976,148 shows a system with an increased diameter portion at the top of the riser, which is depending on a flow by gravity out of the outlet. For this flow to occur, the level of mud in the riser must exceed the level of the highest point of the line between the outlet and the tank (processing area). Consequently, the flow will be intermittent from maximum down towards zero as the telescopic joint telescopes. The level will also only be able to vary along the small height between the highest point of the line and the top of the riser.

The increased diameter portion is formed at the very upper end of the riser and forms a part of the inner sleeve of the slip joint. The mud outlet from the riser is a distance below the increased diameter portion.

EP3128120 and AU2014227488 also show examples of prior art solutions. When building floating rigs, one will typically try to limit the total height from the moonpool up to the drill-floor in order to reduce the build cost of the rig. The telescopic joint is typically deployed so that it is in the splash-zone (where the equipment enters the water, i.e. the water line) during at least part of the stroke. On a typical offshore floating drilling rig, there is typically a flex-joint located below the diverter. The diverter is also where the bell-nipple opens into the flowline. There is typically only a short pup-joint of 7-15 ft (2-5 metres) placed between the flex-joint and the slip joint. This means that there is limited space available between the flex joint and the telescopic joint on existing rigs.

SUMMARY OF INVENTION

The present invention has as a primary object to increase the accuracy of determination of total volume of fluid in the well system. This is particularly useful for risers having a slip joint, but the invention may also be used for risers without a slip-joint where the flow out of the riser varies due to other factors, such as tripping of a drill string.

It is also an object of the invention to be able to use the arrangement in both closed and open systems and regardless of where inlet to the mud handling equipment for returned mud is situated, even if this is close to the top of the riser.

These objects are achieved by the features defined in the appended independent claims. Dependent claims define preferred or convenient embodiments of the invention.

According to the invention a part of the riser below the upper end, i.e. below the bell nipple, but above any slip joint and above any sea level, or above ground for land wells, has a section with increased internal diameter. This part is also referred to as the flow-spool in the following description. The upper level of liquid, such as mud, in the riser is adjusted so that the upper level is largely positioned within the section of increased diameter.

The section of increased diameter is preferably shorter than 3.3 meters (10 ft.) and has a diameter that preferably adds a volume of between 800 and 1100 litres compared to the volume of an equally long riser section without increased diameter. This volume is of the same magnitude as the volume of 300 meter of drill pipe, or a typical volume of riser compression in severe weather.

According to the invention, it comprises a device to continuously measure the position of the slip joint. This measurement is used to calculate the change in volume of the riser due to the extension and contraction of the slip joint. This volume change is further converted into a corresponding change of liquid level in the riser. The calculated change of liquid level is then compared with the actual liquid level to determine if the fluid volume on the well system has changes, such as due to influx or loss to the formation or is the same. Further according to the invention, the section of increased diameter is coupled to an outlet that is capable of conducting fluid from the riser to a fluid return system on board the vessel, such as the mud pit. Preferably, the outlet is coupled to a pump that pumps the fluid, such as mud, out of the section of increased diameter to the fluid return system. The use of a pump allows the outlet from the flow spool, and also the operating liquid level within the flow spool, to be located below the level of the cuttings shakers.

In an embodiment of the invention, there is provided a sensor to measure the flow from the pump as well as a sensor to measure any fluid flow into the well system, such as pumping of mud through the drill string. These flows are taken into the calculations to determine the expected liquid level in the enlarged diameter section.

The invention also provides a method of operating a riser that allows the flow out of the flow-spool to be very close to the flow up the riser, and let the varying flow out of the well caused by the slip-joint motion to be absorbed within the flow-spool. This is achieved by constantly measuring the position of the slip-joint and using this measurement to calculate a volume change from a reference point, herein referred to as "Slip Joint Correction Volume".

A desired level is set within the flow spool, herein referred to as "Flow Spool Set Point". Since the flow spool geometry is known, the "Slip Joint Correction Volume" can be converted to a "Flow Spool Set Point Correction" which is added to the Flow Spool Set Point. This "Corrected Flow Spool Set Point" can then be used as the reference point to a pump controller that is set to keep the flow spool level at the "Corrected Flow Spool Set Point". When there is motion of the slip joint, this "Corrected Flow Spool Set Point" will be continuously changing within the flow-spool.

In order to increase the effective operating volume of the flow spool, the driller may also utilize the volume of riser above the flow spool up to the bell nipple as an active part of the system described herein. Since the internal geometry is known, the relationship between volume and level can easily be calculated and be kept track of. In a second embodiment of the method of the invention, the measured level in the flow-spool is compared with the change in slip-joint position and the flow out of the flow-spool, measured by the flow meter. Based on these readings, the actual flow out of the well is calculated. This value is then compared to the flow into the well, typically given by the flow down the drillstring and boost line, and any volume changes associated with moving tubulars in or out of the well.

During operations, the mud weight of the mud coming out of the well may change for a number of reasons. In a third embodiment of the method of the invention, the arrangement is used to measure the mud-weight of the mud exiting the well. This is done by raising the level to the diverter housing and let the flow exit the bell-nipple. Using the pressure sensors in the flow-spool and the known height from the pressure sensors to the bell-nipple, the mud weight can be calculated. If absolute pressures are being measured, atmospheric pressures may be measured to correct the readings.

In a fourth embodiment of the method of the invention, the known height from the pressure sensors on the pump to the flowline is used to calculate the mud weight. The height from the pressure sensors on the pump outlet and the flowline will be constant. The pressure measured at the pump outlet will be given by: Frictional Losses+mud weight×height×gravitational constant+atmospheric pressure. The atmospheric pressure can be measured. The frictional losses can be calculated. In conditions of low or zero flow the frictional losses will be low or non-existent.

In a fifth embodiment of the method of the invention, the arrangement containing the flow-spool is run in combination with a Surface Back Pressure (SBP) system. In this embodiment, the system is used to measure the leakage rate across the riser sealing device. When operating a Surface Back Pressure system, the return flow from the well is diverted back to the rig through a separate return conduit from the Surface Back Pressure system. Hence, the well flow will not go through the flow spool as in conventional drilling operations. There is, however, a need for monitoring the leakage rate across the SBP sealing device. The leakage across the SBP sealing device will be seen as a volume increase in the flow spool. By using the "Slip Joint Correction Volume" to correct for slip joint movement, the leakage rate across the sealing device can be calculated using the readings from the flow spool. As the leakage rate will be small compared to conventional drilling rates, a preferred method of operation when operating to determine leakage rate across the sealing element, will be to operate with the flow-spool isolation valve closed, allow the level to increase to a threshold value, and then open the flow spool isolation valve and reduce the level by operating the pump, before again closing the isolation valve and let the level increase again. Other operating modes, such as operating the pump with a small flow could also be foreseen.

BRIEF DESCRIPTION OF DRAWINGS

The invention will now be described in further detail, referring to a preferred exemplary embodiment shown in the accompanying drawings, in which.

DETAILED DESCRIPTION OF THE INVENTION

It should be understood that the following detailed description serves as an illustration of an embodiment of the invention and should not be construed to limit the scope of the invention.

Figure 1:
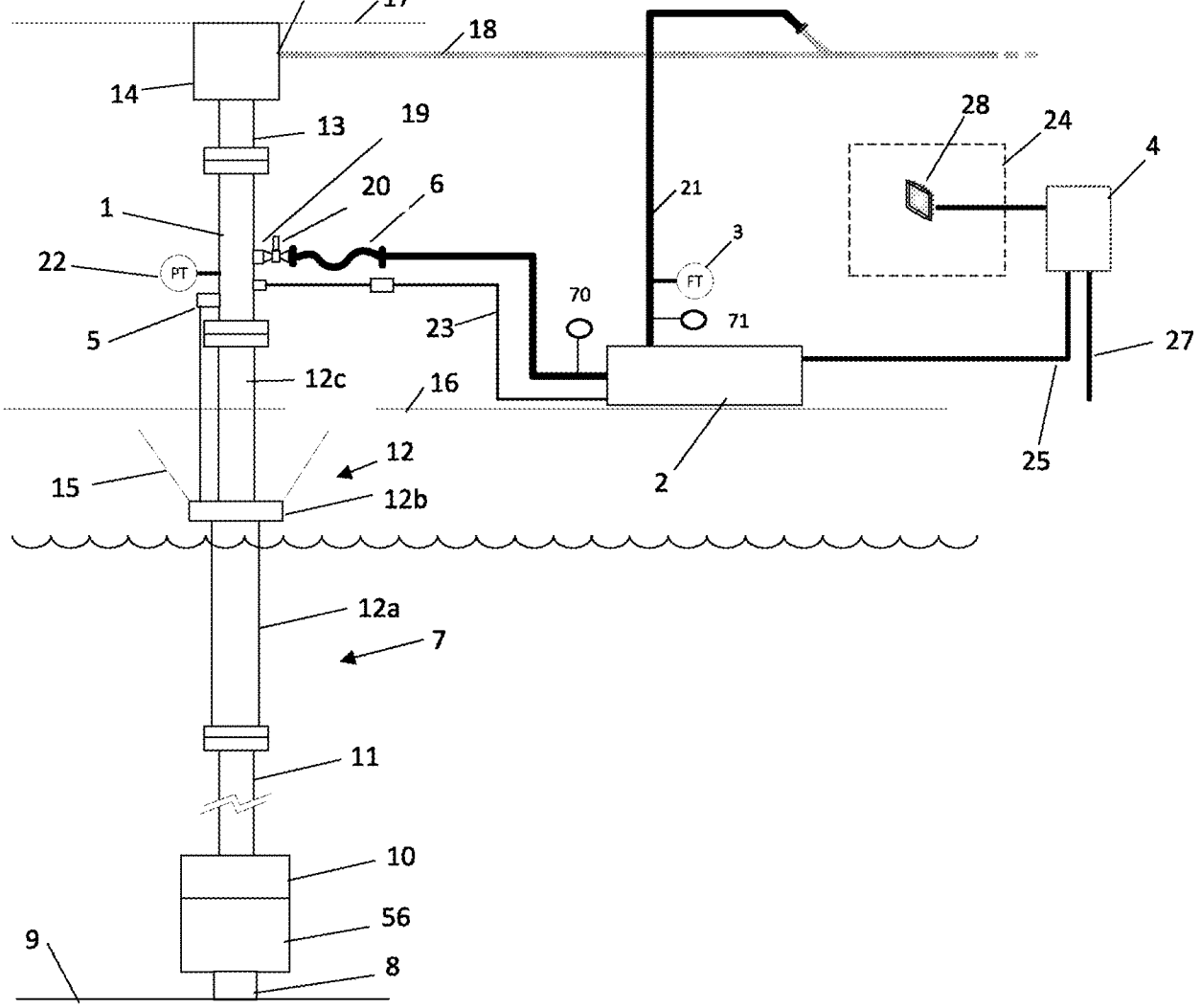
FIG. 1 shows a schematic outline of the invention.

Abbreviations Used in the Description:

BOP Blow Out Preventer
EDR Enhanced Drilling
EKD Enhanced Kick Detection
GPM Gallons per minute
MTBF Mean time between failures
PFD Process Flow Diagram
SG Specific Gravity
VFD Variable Frequency Drive FIG. 1 shows a schematic outline of the invention in a drilling system. Here is shown a drilling riser 7 that extends from a floating drilling facility, such as a drilling platform (not shown) to the seabed 9. The riser 7 comprises conventional units such as a wellhead (WH) 8, which is fixed to a borehole (not shown) that extends into the seabed 9, a blow-out preventer (BOP) 56, attached to the wellhead 8, a lower marine riser package (LMRP) 10, riser sections 11, a telescopic joint (TJ) 12, a flex joint (FJ) 13 and a diverter assembly 14. The telescopic joint 12 comprises an outer barrel 12*a*, a tension ring 12*b* and an inner barrel 12*c*. The tension ring is attached to the platform via tension wires 15.

The riser 7 extends through a main deck 16 of the platform and up to a drill floor 17.

From the diverter assembly 14, there is an outlet 56 through the bell-nipple, to a mud flow return line 18 that extends to a mud return handling system (not shown). The mud return handling system comprises shakers, degasser and other types of conventional equipment to treat the mud to a condition to be reusable.

In use, mud is pumped through a drill string (not shown) that extends from above the drill floor 17, through the riser 7 and into the borehole. Mud exits the drill string from a drill bit at the lower end of the drill string. The mud is returned from the borehole, flow upwards through the riser 7 in the annulus between the drill string and the riser 7 to the diverter 14. From the diverter the mud flows out through the bell-nipple 56 and through the mud flow return line 18 to the mud return handling system. After treatment in the mud return handling system, the mud is again pumped down through the drill string (not shown).

So far, the description of the drilling system and the above operation describes a conventional system. The outline, parts of the system and operation may vary somewhat, but will in general be as described above.

According to the invention, a flow spool 1 has been inserted into the riser, in this case between the telescopic joint 12 and the flex joint 13. The flow spool 1 may however be inserted into the riser 7 at another place in the riser 7 as long as it is above any slip joint in the riser.

The flow spool forms a section of the riser 7 with an increased diameter relative to the major part of the riser 7, such as the riser joints 11.

The flow spool 1 has an outlet 19 that is equipped with a riser isolation valve 20, which preferably is remotely operated.

The outlet is coupled to a mud return line 6 which in turn is coupled to an inlet of a mud return pump 2. The outlet of the mud return pump 2 is in turn coupled to a tie-in line 21 that is coupled to the mud flow return line 18.

The mud return pump 2 has an inlet pressure sensor 70 and an outlet pressure sensor 71

The flow spool 1 is equipped with a pressure sensor 22 and the tie-in line 21 is equipped with a flow meter 3. The flow meter 3 may also be placed elsewhere in the flow line from the flow spool 1 to the mud flow return line 18.

A telescopic joint measurement device 5 is arranged to measure the relative movement between the inner and outer barrels of the telescopic joint 12.

A processor 4 is coupled to the drilling control system through a rig signal input 27 and to the mud return pump 2 through an interface 25. It is also coupled to the pressure sensor 22 via an instrument cable 23. The processor 4 also collects data from the telescopic joint measurement device 5 and the flow meter 3. The processor 4 is capable of running kick detection software, such as an Enhanced Kick Detection (EKD) system.

The processor 4 is linked to a control panel 28 located in the drillers cabin 24

The flow spool 1 forms the interface between the riser system 7 and the EKD system. As explained above, it contains pressure sensors, such as the sensor 22, that reads the pressure inside the riser 7, the riser isolation valve 20 and a connection system for effective connection of a hose of the mud return line 6 and cables, such as the instrument cable 23, between the flow spool 1 and equipment on the deck 16.

The flow spool 1 is preferably located between the upper flex joint 13 and the telescopic joint 12. To have minimum impact on the rig's original riser configuration, the joint of the flow spool 1 should be as short as possible, ideally 10 ft (about 3 metres) or shorter. To be able to fit on both 75" (190.5 cm) and 60.5" (153.67 cm) rotary rigs, there is a preferred max OD of 56" (142, 24 cm) for the flow spool 1.

The level in the riser will be brought down to within the flow spool 1 when using the EKD system. The telescopic joint moves in and out as the rig moves (heave and translational movements), and consequently, the volume of the riser changes. This change of volume in the riser means change of level in the flow spool. The EKD system does in normal operating mode not compensate for this level change by varying the pump rate out of the riser, but continuously monitors the stroke of the telescopic joint to be able to distinguish between volume changes coming from the well, and volume changes caused by telescopic joint movements. As explained above, the telescopic joint position is monitored by the measurement device 5, which will be explained in more detail below. The flow spool 1 should have a sufficient volume capacity to include volume changes as a result of up to +/−2.5 m rig heave, plus operational margins.

It is in most cases important to keep the flow-spool as short as possible. In order to increase the operational window of the system with regards to heave without having to increase the height of the flow-spool to increase the volume, the system may have algorithms that actively control the pump speed to pump faster when the slip-joint is contracting, and slower when the slip-joint is extending.

The design of the flow spool is such that it is self-draining with no dead legs for build-up of particles. This will be explained in detail below.

The invention can in a preferred embodiment function as an Enhanced Kick Detection (EKD) system, but the invention can also function as an Enhanced Loss Detection system, or for any other operation where accurate knowledge of changes in fluid volume in the well are beneficial. The invention will be described below in connection with such a kick detection system. The main functionality of the system is to provide more accurate flow and volume measurements than what is feasible with conventional systems and can be used for any operation where this may yield a benefit. The kick detection system enables rapid kick detection in drilling operations. It comprises a pump system connected to the riser topside on a floating drilling unit. The pump reduces the level in the riser to below the bell nipple and pumps fluid returns from the riser to the flow line in a separate conduit, bypassing the bell nipple. As explained above, a set of pressure sensors 22 are installed on the flow spool 1 and a flow meter 3 is installed in the mud return line 21, providing vital data to the EKD control system. As explained, the system also utilizes a measurement sensor 5 measuring the location of the slip joint tension ring 12*b* in relation to the flow spool 1. This location is then used to calculate changes in riser volume associated with slip joint motion. In addition, a set of rig data, such as pump rate of the rig pumps, dimensions of the riser, etc., are fed into the EKD control system 4. Based on these data, the EKD control system gives the driller information regarding fluid gains or losses in operation.

Figure 3:
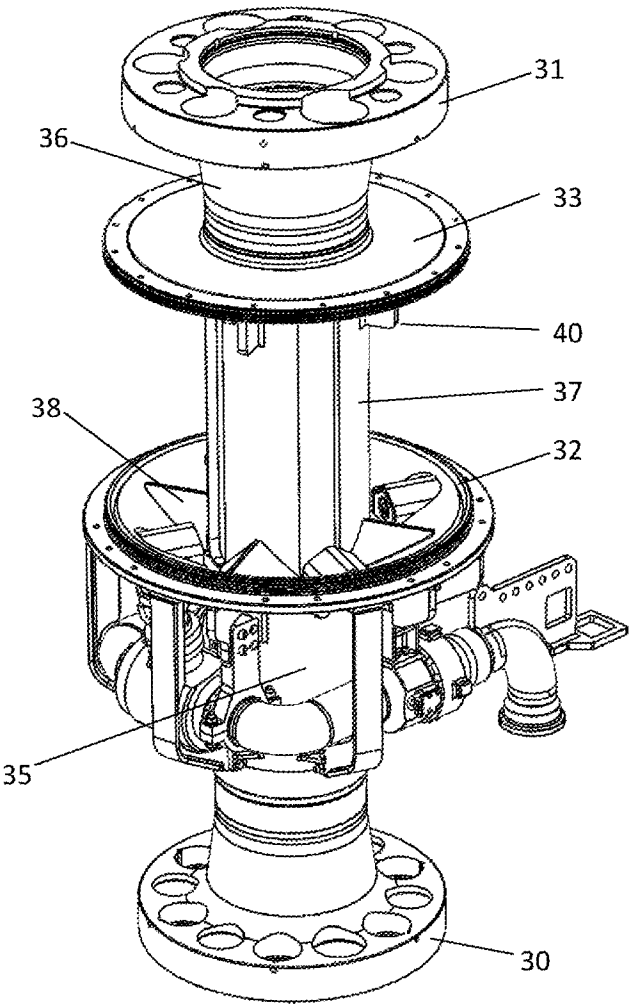
FIGS. 2 and 3 show the flow spool.
Figure 2:
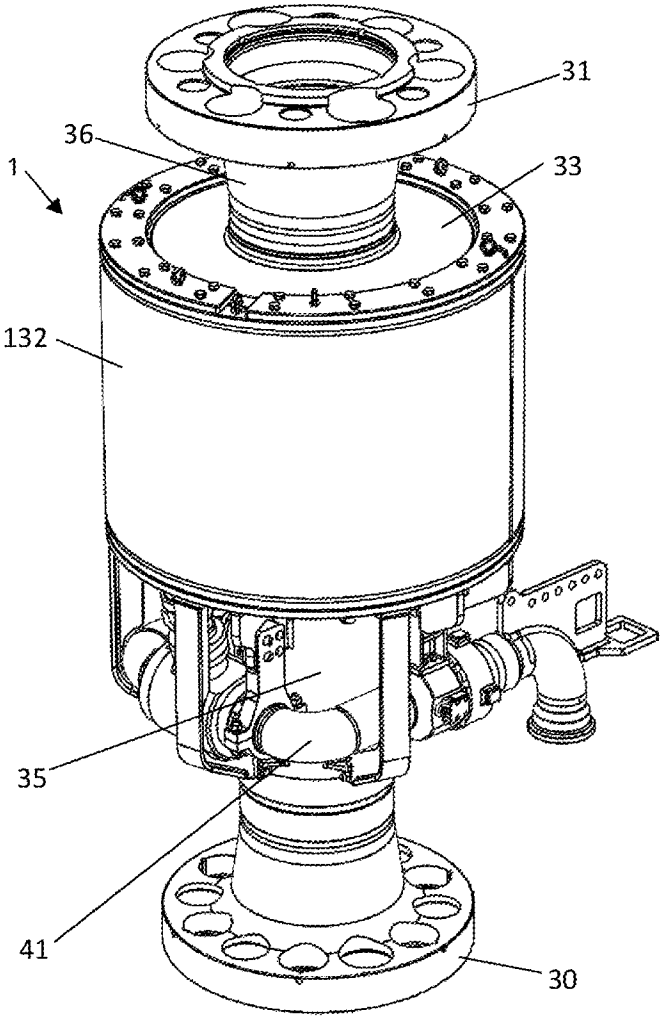

FIGS. 2 and 3 illustrate an embodiment of the flow spool 1. The flow spool 1 comprises a lower flange 30 and an upper flange 31 for connecting the flow spool 1 to the slip joint 12 and the flex joint 13, respectively.

It also comprises an outer barrel 132 that is equipped with a lower end cover 32 and an upper end cover 33. The covers 32, 33 extend radially inwards to join a lower pipe section 35 and an upper pipe section 36, respectively. The pipe sections 35, 36 have a diameter corresponding with the riser diameter.

A perforated pipe section 37 connects the lower and upper pipe sections 35, 36. The perforated pipe section may have cut outs as shown on FIG. 3, longitudinal cut outs from top to bottom or any other pattern that allows flow from inside to outside the perforated pipe.

The lower cover 32 is conveniently conically shaped with a lowest point close to the lower pipe section 35.

Figure 4:
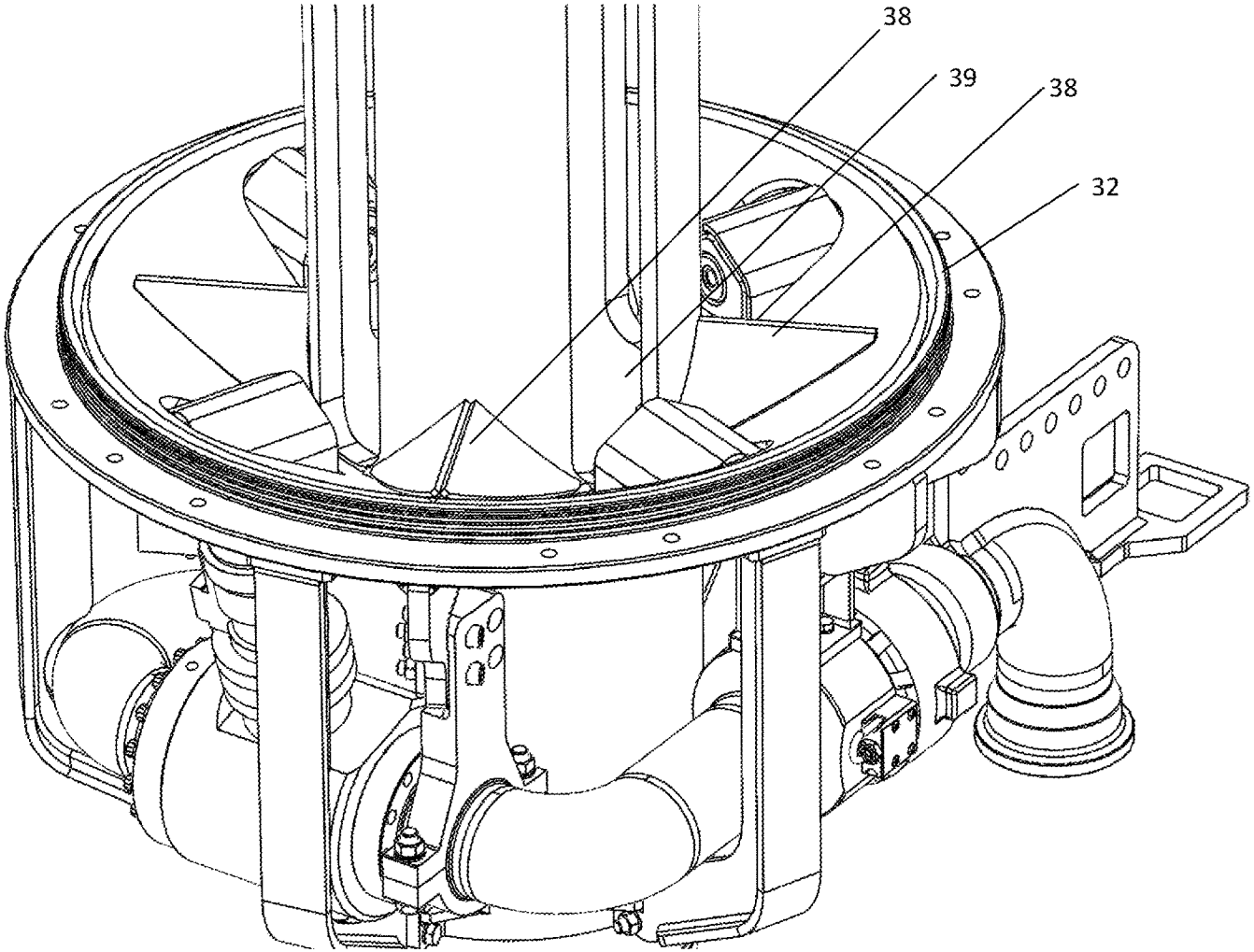
FIG. 4 shows a detail of the deflectors.

Deflectors 38 are arranged on the inside of the lower cover, both for strength and to avoiding settling of particles. These deflectors 38 are shown more detailed in FIG. 4. Holes 39 in the perforated pipe section 37 are arranged at the lower edge of the lower cover 32 to let particles and debris fall into the riser 1.

The upper cover 33 has ribs 40 for strength.

Figure 5:
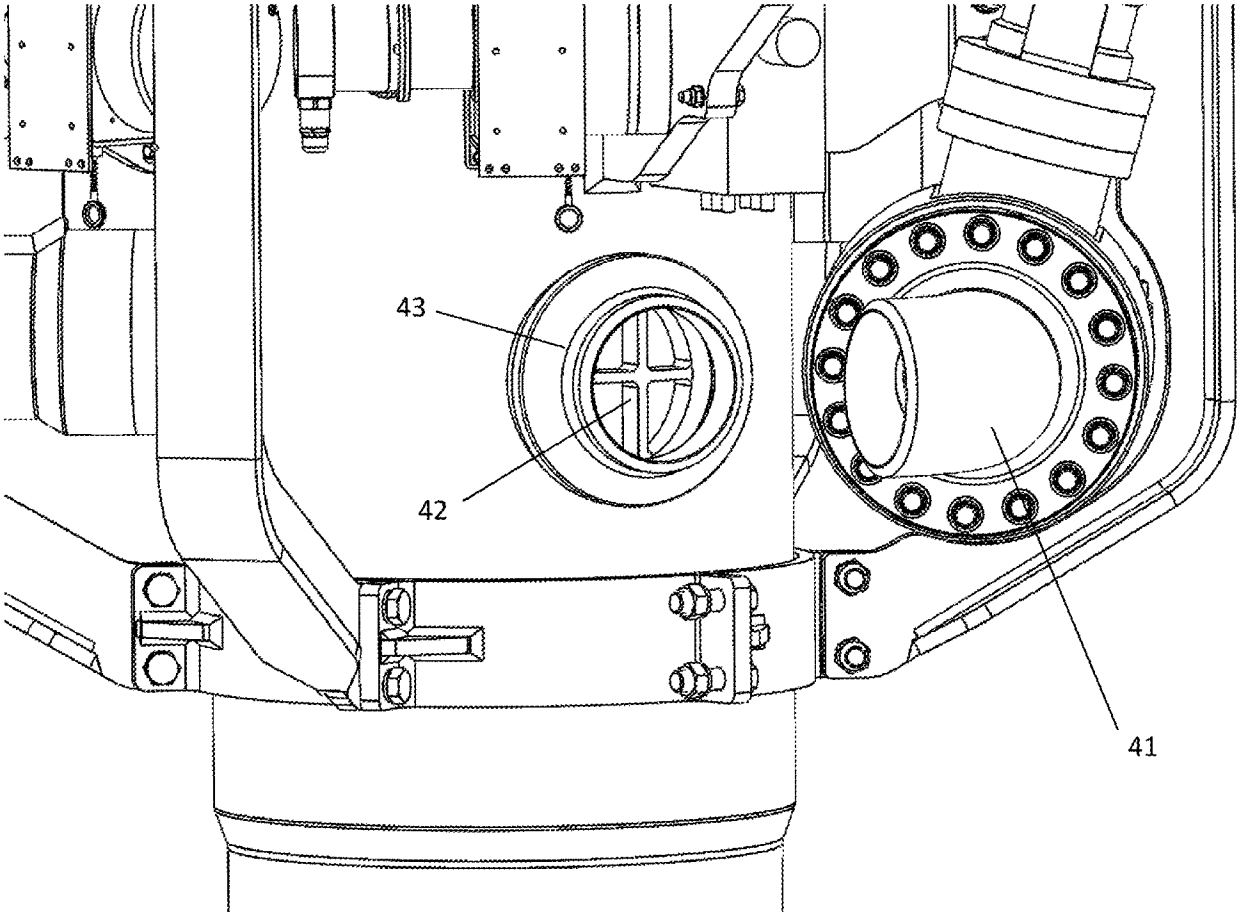
FIG. 5 shows a strainer at the outlet of the flow spool.

The flow outlet 19 from the flow spool 1 is in the form of a conduit 41. As shown in FIG. 5, a strainer 42 is installed in the hole 43 forming the flow spool outlet proper, to prevent large particles to enter the pump system 2. In this figure a part of the conduit 41 has been removed to show the strainer.

Figure 6:
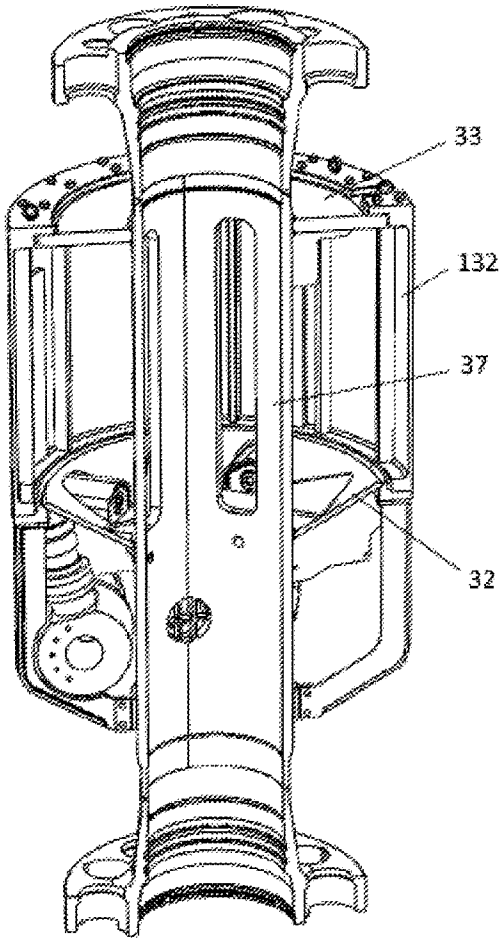
FIG. 6 shows a cross section through the flow spool.

FIG. 6 shows a cross-section through the flow spool 1. As shown, pipe section 37, which is a continuation of the riser 7, is perforated to let fluid flow as freely as possible into the surrounding cavity enclosed by the enlarged diameter barrel 132. Instead of a perforated wall, the riser 7 may also be discontinued through the cavity. However, a perforated riser wall will provide increased strength to the riser 7. The perforated riser wall may take up the tension from the riser 7. The wall perforation may discrete cut-outs as shown in FIG. 6, or the pipe section 37 may alternatively have cut-outs that go longitudinally from top to bottom between the covers 33, 32 to ensure a constant level across the flow spool for better accuracy in operation.

Figure 7:
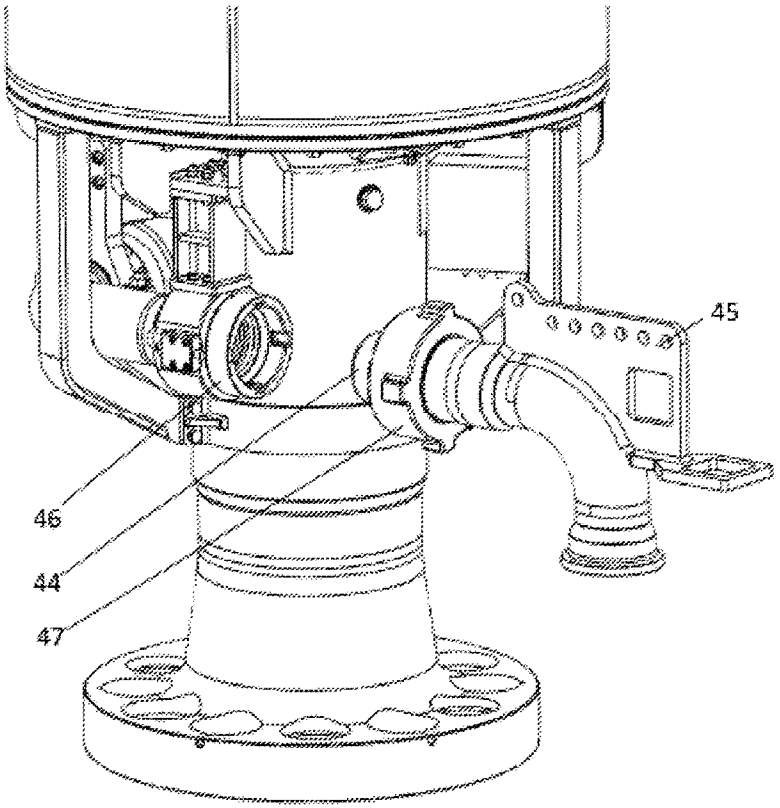
FIG. 7 shows a connection system for connection of the mud return hose.

As shown in FIG. 7, a connection system for safe and efficient connection of the mud return hose is located on the flow spool. The pin end 44 of the connection is mounted to the mud hose 6. It hangs in a tugger, service line or similar to take the weight via a bracket 45 and is horizontally stabbed into the box end 46 and secured with a locking nut 47.

An important input to the EKD control system is the stroke of the telescopic joint on the rig. Preliminary research shows that some rigs are equipped with a system measuring this as part of the riser management system. On other rigs, there is no system measuring this. As the EKD system requires this signal, there are two options available to the user:

Use the rig signal, where available, into the EKD control system

Install a new sensor on rigs where this is not available

Figure 9:
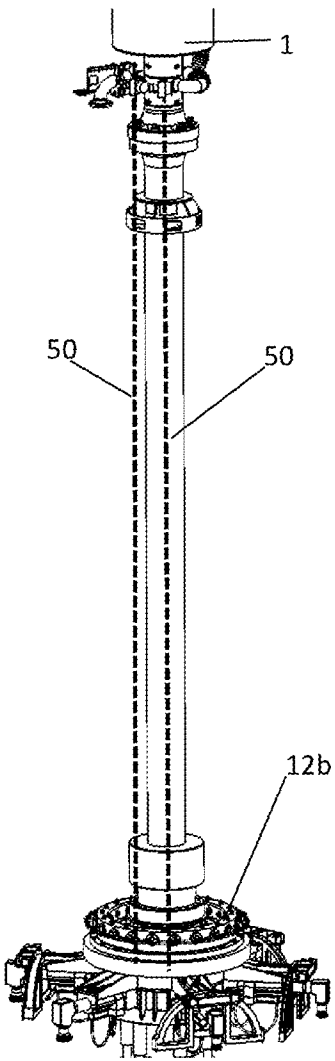
FIG. 9 shows sensor wires coupled between the flow spool and the slip joint.
Figure 8:
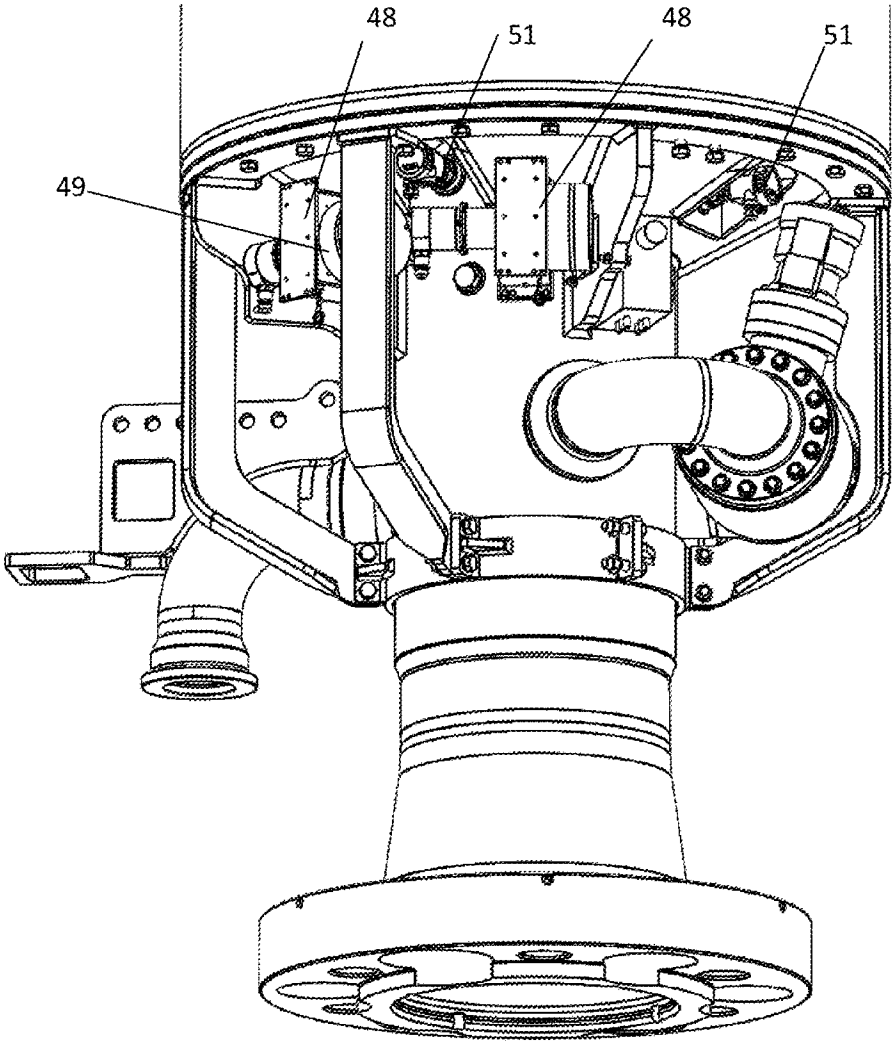
FIG. 8 shows details on the lower part of the flow spool

A preferred sensor is a wire length measuring device, using in a preferred solution a fastening bracket 48 as shown in FIG. 8, installed between the flow spool and the outer barrel of the telescopic joint, as shown in FIG. 9. This is a proven and accurate method used both by riser monitoring systems and wireline/logging companies.

The sensor 5 comprises a reel 49 that is rotatably mounted to the bracket 48. The reel 49 contains a thin but durable wire, line or cord 50 that is attached to the tension ring 12*b* at its free end. When the slip joint moves relative to the flow spool 1, the cord will be reeled in and out from the reel 49. A sensor detects the rotation of the reel and hence the length of cord extending between the reel and the tension ring 12*b* can be accounted for.

As alternatives a laser or pressure sensors inside the slip joint may be used to measure the slip joint movement.

Due to the criticality of this sensor input, dual sensors will be used for redundancy, as shown in FIGS. 8 and 9.

FIG. 8 also shows the pressure sensors 51 mounted at the bottom of the flow spool. In a preferred embodiment, four sensors are used The flow spool is connected to the surface piping using a flexible mud return hose 6*a*. The hose 6*a* preferably has the same specification as the mud boost line hose (not shown) of the rig.

In addition, an electric cable 23 for power supply and control will be connected between the flow spool sensors and the EKD control system. This cable may be bundled with the mud return hose 6*a*. The hose 6*a* will be connected to the flow spool 1 after the flow spool 1 has passed the rotary. As a valve 20 isolates the flow spool 1 during the installation, the connection of the hose 6*a* will not be performed on rig time. The term rig time denotes time spent that delays the drilling operation. The hose 6*a* will be connected to a gooseneck system for safe and efficient connection of the hose.

Figure 10:
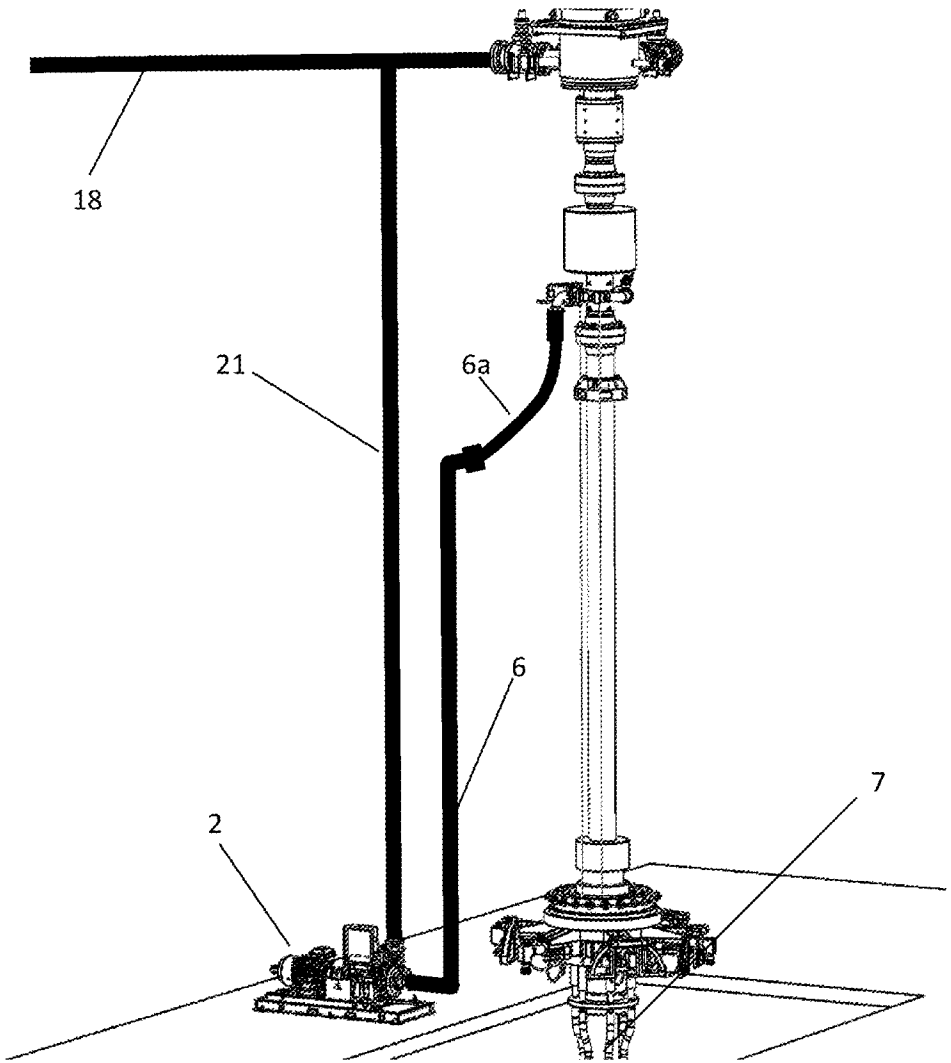
FIG. 10 shows the system of the invention with a pump skid connected between the flow spool and the mud flow line.

A topside pump skid 2, as shown in FIG. 10, is used to pump fluids from the riser 7 up to the flow line 18, through the mud line 6 and the tie-in line 21. The skid 2 is made as small as practically possible for ease of installation. The pump arranged in the skid 2 is selected based on experience from similar applications, pumping mud with cuttings in drilling operations. The driveline and motor are sized according to the project's defined operational envelope in terms of flow rates and mud weights. The pump is preferably a centrifugal pump but may also be a positive displacement pump, such as a piston pump.

The pump motor is controlled by a VFD placed in the EKD control system cabinet located in an electrical room inside the rig.

A junction box is placed on the skid for connecting all sensors and cables on the skid. The junction box includes a panel-mounted emergency stop.

At the outlet side of the pump skid 2 is arranged a flow meter 3, such as a Coriolis flow meter to measure the flow of mud out of the pump. The flow meter is mounted downstream the pump and measures the return flow in the system. The flow meter could also be mounted upstream of the pump.

The EKD control system will inform the driller about any flow anomalies in operation and give an easily interpretable graphical representation of these events.

The EKD control system vital input parameters, in addition to the conventional rig readings are:

- Pressure readings in the flow spool 1 for volume measurements
- Flow meter readings on the mud flow out of the pump 2
- Position sensors 5 determining the position of the outer barrel 12*a* in relation to the inner barrel 12*c*.
- For some operational modes, the pump outlet pressure sensor 71 is also used.

In addition, the control system gets input from the rig's drilling control system such as: hook height, flow in, pit volumes etc.

Based on the sensor inputs and the control system algorithms applied, the EKD control system automatically alerts the driller when a flow or volume anomaly is detected.

The pump skid 2 is conveniently placed such that the piping length is minimized on both the suction and exhaust side of the pump. At the same time, the pump needs sufficient suction head. The ideal placement is thus as close as possible to the well centre, down on the lower deck 16, as close as possible to the flow line 18. On typical drill ships there is room for the skid 2 close to the well centre on the starboard side of the moon pool. The flow line 18 from the diverter passes straight above this location, so piping stretches are minimized. This is illustrated in FIG. 11.

The philosophy for the EKD system is that there should be little or no modifications to the existing drilling control system onboard the vessel. The EKD system requires a number of "read-only" tags from the rig system, either directly through an interface to the drilling control system or via mud logger's interface. In addition, the driller should be able to isolate the riser isolation valve 20 (fail-safe-close) via the diverter control system.

Referring to FIGS. 11-18 is shown a high-level deployment sequence for the system. The focus is on safe and efficient handling.

Figure 11:
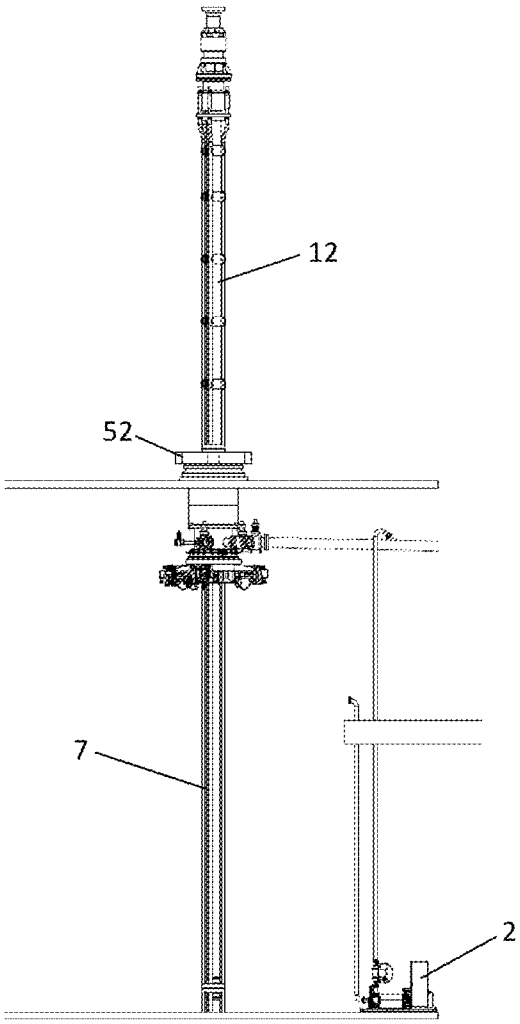

Step1 is shown in FIG. 11:

The riser 7 and the BOP 10 (not shown in FIG. 11) are deployed as conventional. The telescopic joint 12 is connected to riser 7 in the spider 52.

Figure 12:
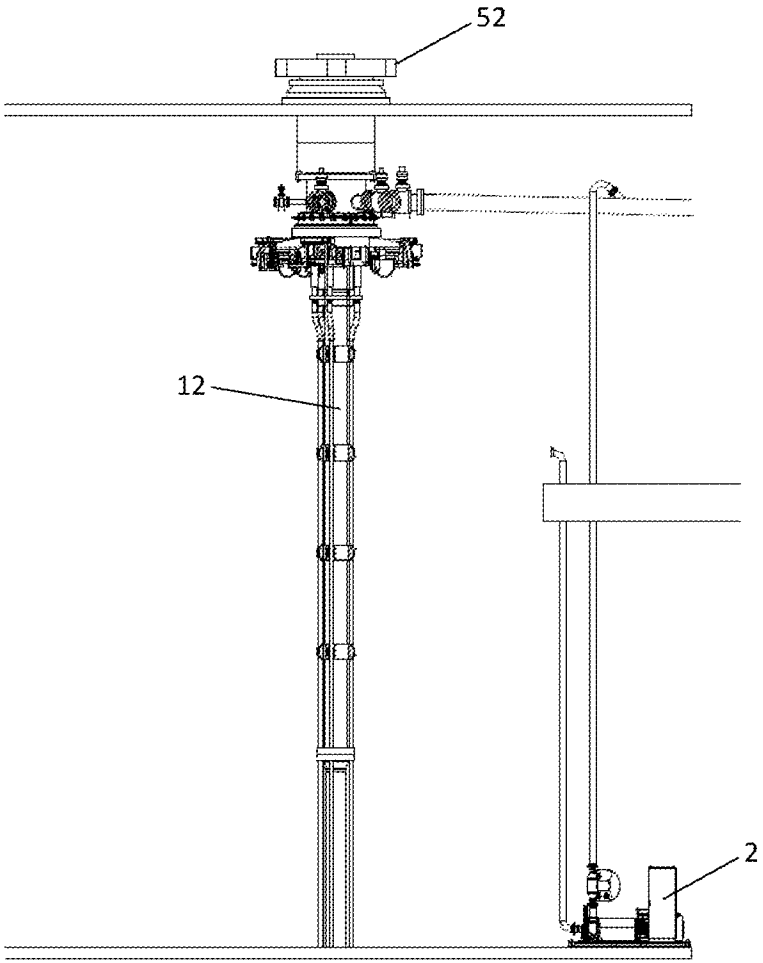
FIGS. 11-18 shows a sequence of the installation of the arrangement of the invention.

Step 2 is shown in FIG. 12:

The telescopic joint 12 is landed in the spider 52.

Figure 13:
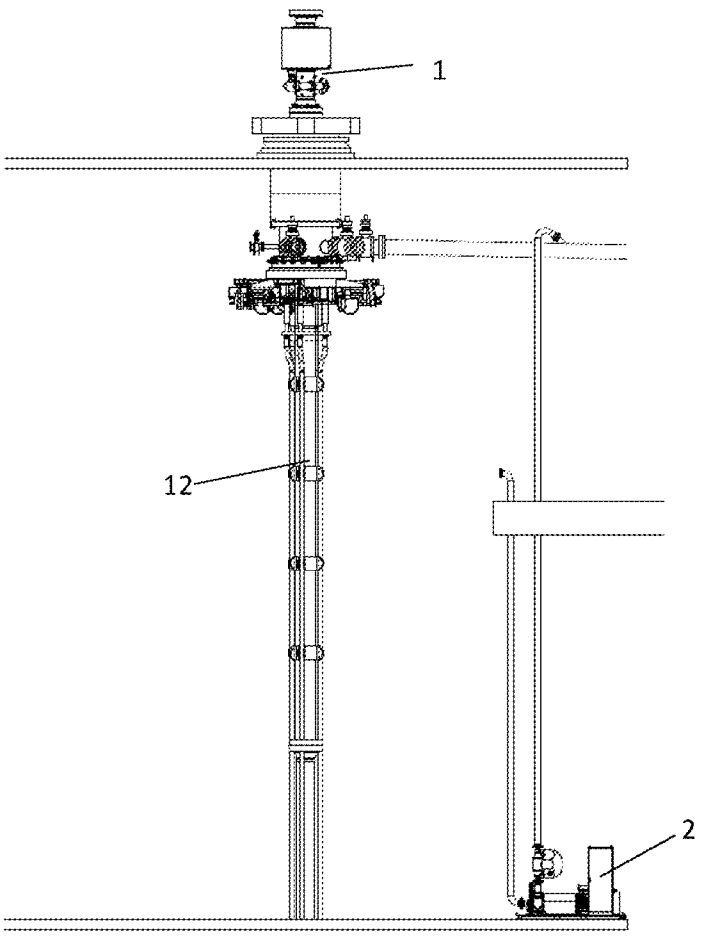

Step 3 is shown in FIG. 13:

The EKD flow spool 1 is installed and flanged to the telescopic joint 12.

Figure 14:
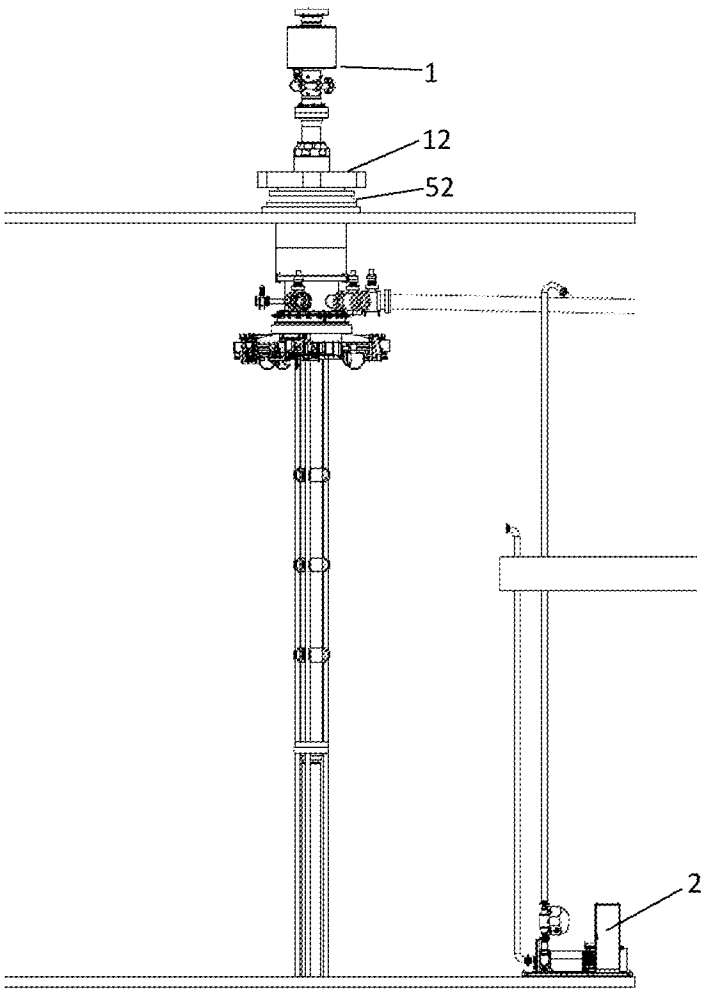
Figure 15:
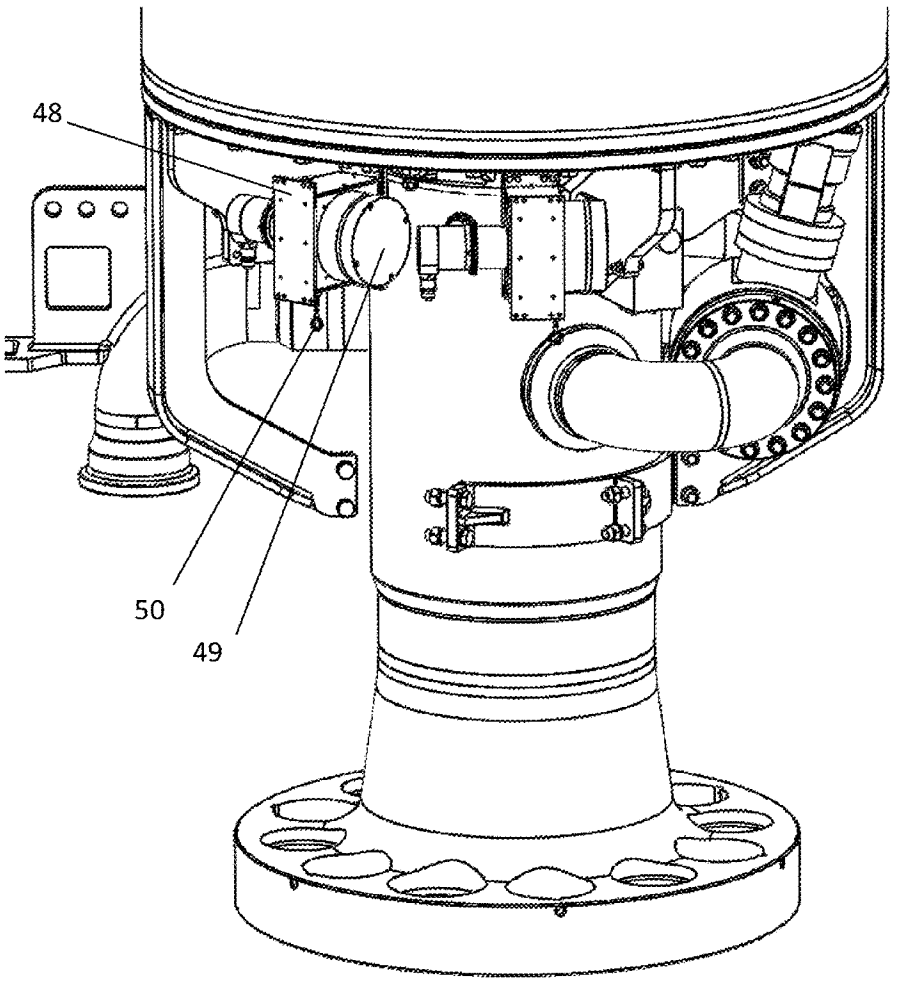

Step 4 is shown in FIGS. 14 and 15:

The spider 52 is opened, and the riser string 7 is lifted about 3 meters to get access to the outer barrel 12*a* of the telescopic joint 12. The measurement wires of the length measurement sensors are connected between the flow spool 1 and the telescopic joint 12. The flow spool 1 is lowered and landed off in the spider 52. FIG. 15 shows a detail of the lower end of the flow spool 1 with the measurement reel 49 and cord 50.

Figure 16:
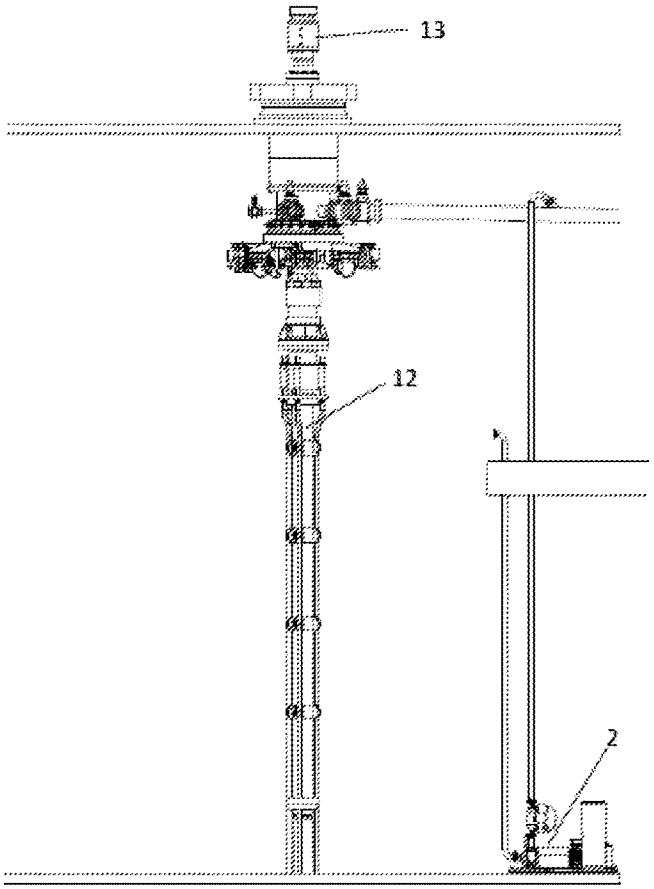

Step 5 is shown in FIG. 16. The flex joint 13 is connected to the flow spool 1 and the running of the riser is thereafter continued as conventional.

Figure 17:
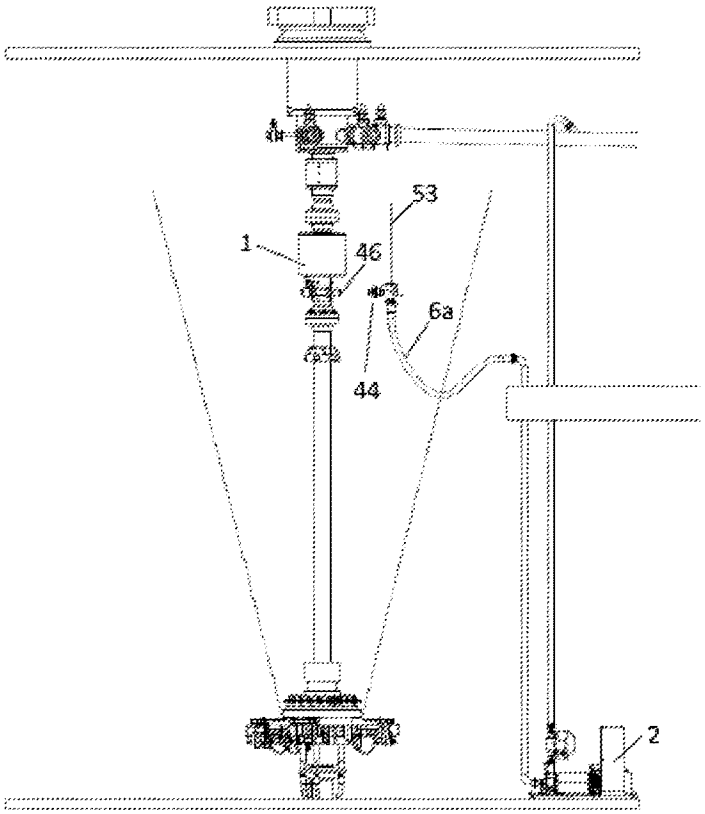

Step 6 is illustrated in FIG. 17. The mud return hose 6*a* between the flow spool 1 and the pump skid 2 is installed. This is done by using a tugger crane (not shown) with a wire 53 attached to the outer end of the hose 6*a* to support the weight of the hose. The connector pin end 44 of the hose 6*a* is then aligned with the box end 46 on the flow spool 1, where after the two are mated and secured. Then control lines for valves and sensors are connected (not shown here).

Figure 18:
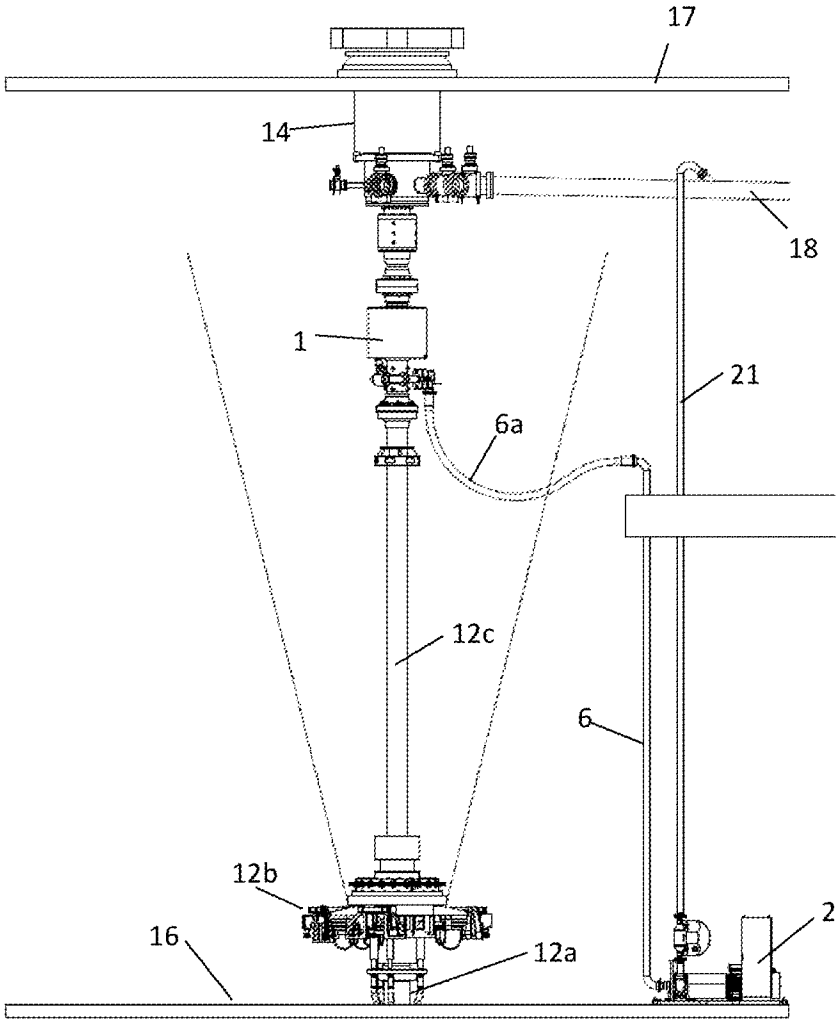

Step 7 is shown in FIG. 18. With all the connections made, the system is tested and made ready for operation.

The EKD system works as follows:

The liquid level in the riser 7 is adjusted, by using the return pump 2, to a level that is within the flow spool 1, i.e. in the increased diameter section. Level sensors, such as pressure sensors 22, in the flow spool 1 detects the level.

Mud is pumped down the drill string and into the well. As mud flows up through the annulus between the drill string and the riser 7, mud is pumped out of the flow spool via the return pump 2.

In a first control mode, the pump rate out of the flow spool 1 is adjusted to correspond with the pump rate into the well. If the slip joint 12 is stationary, i.e. there is no heave motion or any drift off of the drilling vessel, the mud level would have been substantially constant in the flow spool 1.

However, as the slip joint extends and contracts, mud is displaced up and down inside the riser 7 above the slip joint 12. This causes the level of mud to vary. The flow spool 1 has a large enough diameter that the change in level within the flow spool 1 is limited. Preferably, the level is kept within the flow spool 1.

As the slip joint 12 telescopes, the movement of the slip joint 1 is measured by the movement sensors 5 described above. As the internal diameter of the slip joint 12 is known, the resulting volume of mud displaced can be calculated. This is done in virtually true time. This volume displacement is then used to determine the expected level change inside the flow spool 1, along with any difference in mud volume pumped into the well and out of the flow spool 1. The expected mud level is then compared with the actual mud level measured by level or pressure sensors in the flow spool 1.

In one operational mode of the system, the level in the flow-spool is allowed to change to absorb any influxes or losses. In this mode, if the actual mud level is different from the expected mud level, this may be because of an influx from the formation into the well or a loss of mud into the formation. A notification or alarm will then be given to the driller, who then can initiate appropriate measures to meet the situation.

The volume within the flow spool 1 may not be sufficient to accommodate for displacements of mud at the maximum stroke of the slip joint 12. The flow spool 1 is typically designed to accommodate for displacements within the normal operation window of the slip joint 12. Nevertheless, if the level of mud moves below or above the flow spool 1, an influx or loss of mud may still be detected. This is due to the fact that increases or decreases that go beyond the volume of mud displaced by the slip joint 12 can be detected as the level moves past the volume of the flow spool 1 on each heave period. This is due to the accurate measurement of slip joint 12 movement and the short distance between the slip joint 12 and the flow spool 1. Consequently, the displacement of mud due to the slip joint 12 movement will practically immediately be detected in the flow spool 1.

During operations, drilling equipment such as drill pipe or casing strings are run into the well. This equipment has a certain displacement volume per unit length which varies from component to component, but which can be measured and will be known. It is common practice to have a Driller's Tally for all equipment going into the well. The Driller's Tally, the location of each piece of equipment and the speed with which equipment is being run into the well can be used to correct the flow and volume measurements for this displacement volume.

In the first control mode described above, the system is controlled based on flow measurements. In a second control mode, the system is controlled based on the level in the riser 7. In this control mode, the system will try to keep a virtual set-point constant, which continuously is corrected for the slip joint 12 position. The method is as follows:

A mud level within the flow-spool is set as a set-point. Typically, this will be at the middle of the flow spool 1.

A slip-joint reference point is set.

A virtual level set-point is created. This virtual level set-point is the level set-point given above, corrected for the level change associated with slip joint motion from the reference point. This means that for a contracted slip-joint the virtual level set-point will be higher than the level set-point and for an extracted slip-joint the virtual level set-point will be lower than the level set-point.

The pump controller, typically using a PID or PI controller, will be operated to maintain the riser level as close to the virtual set-point as possible. This means that for operations where there is slip-joint motion, the normal operating mode will be to let the riser level increase and decrease continuously.

The pump controller will not be able to keep the level exactly equal to the virtual level set-point at all times. The volume associated with this deviation needs to be calculated and accounted for. This is done by comparing the virtual level set-point to the actual level at all times. Since the flow-spool geometry is known, these readings can be converted to a volume. By calculating this volume change per time unit, an equivalent flow-spool flow rate can be calculated.

The volume change or volume change per time unit associated with displacement volume from equipment going into or out of the well are also being measured and calculated.

The flow readings, flow in, flow out and flow-spool flow rate and the displacement volume, are then compared to determine if there is a gain or a loss in the well.

Since there are uncertainties associated with measurement accuracy, sensor drift and so on, a data filter, such as a Kalman filter will typically be applied to the readings to determine whether there is a gain or a loss in the well.

The driller will use threshold values to be alerted if there is a gain or a loss.

In some cases, the well is being drilled in formations where there is a constant loss of mud into the formation. In such cases, the driller may decide that it is safe to continue operations with constant losses. He may then set the maximum acceptable loss to be alerted if the loss exceeds this threshold.

In other cases, there might be large temperature differences between the mud and the formation, leading to a constant heating of the mud. As the mud typically expands as it is heated, this heating will be seen as an increase in volume. The driller may in some cases decide that since the cause of the volume increase is known, drilling may continue safely.

There are many other situations than the examples above where the driller may decide to continue operations with a measured gain or a loss. The point of the above is to illustrate that operations may be performed with a known constant gain or loss. In such cases, the flow measurements will be corrected for this known gain or loss and the threshold values set accordingly.

If the temperature profile in the well is known, the temperature of the mud can be measured, and using known properties of the mud, the temperature increase of the mud can be calculated. This temperature increase can in turn be used to calculate mud density effects and associated volume changes caused by the temperature.

The system can also be used to perform an enhanced static flow check, or to monitor the well when tripping pipe in or out of the well. For a flow check, the riser isolation valve 20 is closed. The level in the flow-spool 1 is measured and corrected for the slip-joint motion. Since the geometry of the flow spool, and the piping above the flow-spool up to the bell-nipple 56 is known, the level measurement can be converted to a volume. For the static flow check, the drill pipe will normally be pulled off bottom, which means that the pipe will move up and down with rig heave. The flow-spool mud level can be corrected for this pipe displacement volume if these measurements are available.

For tripping out of the well, the mud level is brought as close to the top of the flow-spool 1 as the current heave conditions will allow without overflowing through the bell-nipple 56. The riser isolation valve 20 is then closed. The riser level is measured and corrected for slip-joint motion and pipe displacement. As the drill pipe is pulled out of the hole, the level in the flow-spool 1 will drop. When the level has dropped to a certain level, dictated by the current rig motion conditions, the level will be raised by pumping mud into the well, typically through the boost line (not shown). This increase in riser level, may or may not involve opening the riser isolation valve 20 and operating the pump 2.

For tripping drill pipe into the well, the mud level will be brought as low as operationally feasible given the current rig motion conditions, the riser isolation valve 20 will be closed and volume measurements performed as above. Once the level reaches an upper limit, set by the current rig motion conditions, the riser isolation valve 20 will be opened, and the flow-spool 1 drained to the lower limit using the pump 2.

To use the system to measure the leakage rate across an annular sealing element for Surface Back Pressure (SBP) operations (this is explained in detail in the co-pending application PCT/NO2020/050266, which is incorporated herein by reference), a methodology similar to that of tripping drill pipe into the well is used. The level is brought to a low limit given by the rig motion conditions and the riser isolation valve 20 is closed. The flow-spool level is measured and corrected for the slip-joint motion. The virtual level is then converted to a volume, using the known geometry of the flow-spool. Since the well fluid is conveyed back to the rig through the SBP system from below the SBP annular sealing element, the drill pipe displacement correction will be the change in length from the SBP sealing element in the riser up to the flow-spool 1. This length change will equal the change in stroke length of the slip-joint 12, which is being measured. The person skilled in the art will know how to perform such corrections. The Driller can now monitor the leakage rate across the SBP sealing element. Once the flow-spool level reaches an upper limit, the riser isolation valve 20 is opened, and the pump 2 operated to bring the flow-spool level down to a low level. The riser isolation valve 20 is then again closed and the process repeated. The flow out of the flow-spool may be measured using the flowmeter 3 when emptying the flow-spool 1 and these measurements may be used in the SBP annular sealing element leakage rate calculations, but typically the period that the riser isolation valve 20 is open will be so short compared to the period it is closed that the leakage in this period can be neglected.

The invention claimed is:

1. An arrangement to control volume of fluids in a gas or oil well system having a riser extending from a well to a rig, the riser having an increased diameter section relative to a major part of the riser, the increased diameter section being situated below the upper end of the riser and above sea level or ground level, and above any slip joint in the riser; the arrangement further comprising a sensor to continuously measure the position of the slip joint; the increased diameter section being coupled to an outlet that is in fluid communication with a mud return system, wherein the arrangement further comprises a return pump coupled between the outlet and the mud return system, the outlet being arranged at a lower level than the mud return system, the pump being positioned to pump mud from the outlet to the mud return system, and level sensors measuring the level of liquid within the increased diameter section, wherein the liquid level in the riser is adjusted, by using the return pump, to a level that is within the increased diameter section.

2. The arrangement of claim 1, the arrangement comprising a first flow sensor to measure the fluid flow through the pump, a second flow sensor to measure any fluid flow into the well system, such as pumping of mud through the drill string.

3. The arrangement of claim 2, the arrangement comprising a control system; the control system calculating an expected level of liquid in the increased diameter section based on slip joint position sensor measurements, which corresponds to amount of liquid being displaced due to slip joint extension and contraction, flow rate of liquid into the well system and flow rate of liquid out of the increased diameter section through the return pump; and the control system comparing the expected level with an actual measured level of liquid in the increased diameter section.

4. The arrangement of claim 2, wherein the control system is set to adjust the pump rate through the return pump to correspond with the pump rate into the well system.

5. The arrangement of claim 3, wherein the control system, when a higher actual measured level of liquid than expected level is detected, initiates an alarm to indicate a possible influx into the well.

6. The arrangement of claim 3, wherein the control system, when a lower actual measured level of liquid than expected level is detected, initiates an alarm to indicate a possible loss of liquid into a formation into which the well extends.

7. The arrangement of claim 1, wherein the outlet from the riser is arranged at a higher level than the slip joint.

8. The arrangement of claim 1, wherein an isolation valve is provided to close the fluid communication between the outlet and the return pump.

9. The arrangement of claim 8, wherein a closed isolation valve enables conventional use of the riser system.

10. The arrangement of claim 1, wherein the increased diameter section is shorter than 3.5 metres.

11. The arrangement of claim 1, wherein the sensor to measure the position of the slip joint comprises a reel and a wire, line or cord attached to the reel at one end and having an opposite free end, the reel and the free end of the wire, line or cord being attached to a respective side of relatively moving parts of the slip joint so that the wire, line or cord is being reeled on and off the reel as a response to the relative movement of the slip joint parts.

12. The arrangement of claim 1, wherein the major part of the riser is a riser joint.

* * * * *